US005818163A

United States Patent [19]

Yang

[11] Patent Number: 5,818,163

[45] Date of Patent: Oct. 6, 1998

[54] FLUORESCENT SCREEN PATTERN FOR BEAM INDEX TUBE AND BEAM INDEX TUBE INCLUDING THE PATTERN

[75] Inventor: Hak-cheol Yang, Suwon, Rep. of Korea

[73] Assignee: Samsung Display Devices Co., Ltd., Kyungki-do, Rep. of Korea

[21] Appl. No.: 756,580

[22] Filed: Nov. 27, 1996

[30] Foreign Application Priority Data

Mar. 19, 1996 [KR] Rep. of Korea ..... 96-7364

[51] Int. Cl.[6] ..... H01J 29/10

[52] U.S. Cl. ..... 313/471; 313/466

[58] Field of Search ..... 73/461, 463, 466, 73/471

[56] References Cited

U.S. PATENT DOCUMENTS

| | | | |
|---|---|---|---|
| 3,102,967 | 9/1963 | Focht | 313/471 |
| 3,524,094 | 8/1970 | Hasker et al. | 313/471 |
| 3,691,424 | 9/1972 | Goodman | 313/466 |
| 4,635,106 | 1/1987 | Shinkai | 313/471 |
| 4,720,655 | 1/1988 | Hinotani et al. | 313/471 |
| 4,757,231 | 7/1988 | Kato et al. | 313/466 |
| 4,908,547 | 3/1990 | Toyama et al. | 313/471 |
| 4,990,824 | 2/1991 | Vriens et al. | 313/466 |

*Primary Examiner*—William L. Oen
*Attorney, Agent, or Firm*—Leydig, Voit & Mayer, Ltd.

[57] ABSTRACT

A screen for a beam index tube includes a fluorescent surface having a pattern of color stripes respectively producing red, green, and blue light in unit areas within the stripes in response to an incident electron beam and index unit areas regularly arranged in the pattern, the color stripes being arranged side-by-side and along a vertical direction with color unit areas of vertical stripes being in registration along a horizontal direction, each color unit area being spaced in the horizontal and vertical directions from the nearest color unit area by one unit area, and the index unit areas being disposed among the color unit areas and spaced from the nearest index unit area by three unit areas in the horizontal direction and one unit area in the vertical direction. A beam index tube may include the screen in combination with a tube assembly and an electron gun. Since the index unit areas are not spaced from nearest color unit areas, vertical deflection correction of the electron beam is not required and can be omitted. Thus, the picture quality produced is not adversely affected by the earth's magnetic field and manufacturing costs are reduced by avoiding the elements needed for the vertical deflection correction.

7 Claims, 5 Drawing Sheets

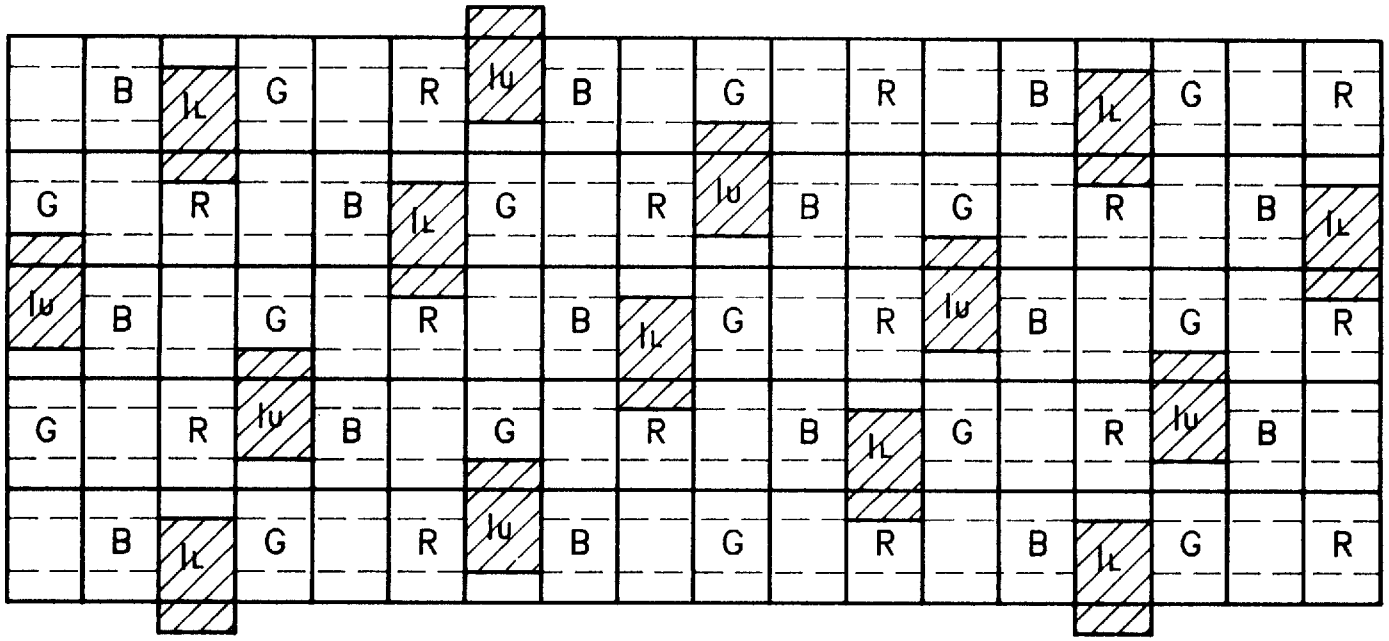
B
G
R
B
G
R
B
G
R

FLUORESCENT SCREEN PATTERN FOR BEAM INDEX TUBE AND BEAM INDEX TUBE INCLUDING THE PATTERN

BACKGROUND OF THE INVENTION

The present invention relates to a beam index tube. More particularly, the present invention relates to an improved screen assembly for a beam index tube.

A beam index tube is a kind of cathode ray tube in which an electron beam scans a fluorescent surface on which red, green, blue and index stripes are arranged. The position of the beam is controlled on the basis of an index signal derived from the index stripes.

FIG. 1A discloses a conventional beam index tube and FIG. 1B depicts an exploded view of the screen of the conventional beam index tube. The index light reflects, according to the stripe array structure, on the screen when the electron beam from electron gun 12 is scanned to the red stripe R, the green stripe G, and the blue stripe B. The photodetector 21 converts the input index light into an electrical signal and outputs an index signal. The index signal processor 22 controls the time of the output of the video multiplexer 23 according to the input index signal. The video signal from the video multiplexer 23 is amplified in the video amplifier 24 and the amplified signal determines whether the stripe will be lit or not.

FIG. 1B depicts a conventional screen for a beam index tube in which the red stripe R, the green stripe G, and the blue stripe B are arranged on a fluorescent surface. The stripes are arranged such that they are spaced in the horizontal and vertical directions by an interval of 1 mesh by a black matrix. Index stripes are provided and arranged with a 5 mesh interval in the horizontal direction on the black matrix. Consequently, the screen has one index stripe per triplet where triplet refers to one RGB stripe area.

FIG. 1C is a diagram showing a second screen pattern of a conventional beam index tube. As shown, each stripe area is partitioned in a mesh, and red R, green G, blue B, lower index $I_L$, and upper index $I_U$ stripes, each of which occupy the same area, are regularly arranged. Here, red R, green G, and blue B stripes are arranged horizontally, being spaced by an interval of one mesh between each stripe. Thus, the allowance of the horizontal spot size of the scanning electron beam can be increased.

FIG. 2 is a diagram illustrating an index signal with respect to a horizontal pattern shown in FIG. 1C.

In FIG. 2, $E_U$ represents a landing electron beam spot shifted upward from the stripe of the screen, $E_C$ represents a correctly landing electron beam spot, $E_L$ represents a landing electron beam spot shifted downward from the stripe, $S_U$ is an index signal for the upward-shifted electron beam, $S_C$ is an index signal for the correctly landing electron beam, and $S_L$ is an index signal for the downward-shifted electron beam. Accordingly, to control the position of the electron beam, the signal $S_H$ is generated to direct the electron beam scanning downward by an extra vertical deflection correcting means, and the signal $S_L$ is generated to direct the electron beam scanning upward by the vertical deflection correcting means.

The above conventional beam index tube, however, has problems. First, an extra vertical deflection means is needed. Second, if the vertical position of the electron beam is unstable due to the earth's magnetic field, the frequency of the index signal cannot be accurately detected. Thus, the position of the electron beam cannot be controlled, resulting in a color shifting phenomenon on the screen.

SUMMARY OF THE INVENTION

To solve the above problems, it is an object of the present invention to provide a beam index tube in which vertical deflection correction of an electron beam is unnecessary.

To achieve the above object, there is provided a beam index tube which scans a fluorescent surface on which red, green, blue, and index stripes are regularly arranged using a single electron beam, and controls the position of the beam on the basis of an index signal from the index stripes, wherein each stripe area formed on the fluorescent surface is partitioned in a mesh type, the red, green and blue stripes are arranged in the horizontal direction being spaced by an interval of one mesh, and the index stripes are arranged with each predetermined interval in the horizontal and vertical directions, located in the fluorescent surface without being spaced.

BRIEF DESCRIPTION OF THE DRAWINGS

The above object and advantages of the present invention will become more apparent by describing in detail a preferred embodiment thereof with reference to the attached drawings in which:

FIG. 1C is a diagram illustrating another screen pattern of a conventional beam index tube;

DETAILED DESCRIPTION OF THE INVENTION

Figure 1A:
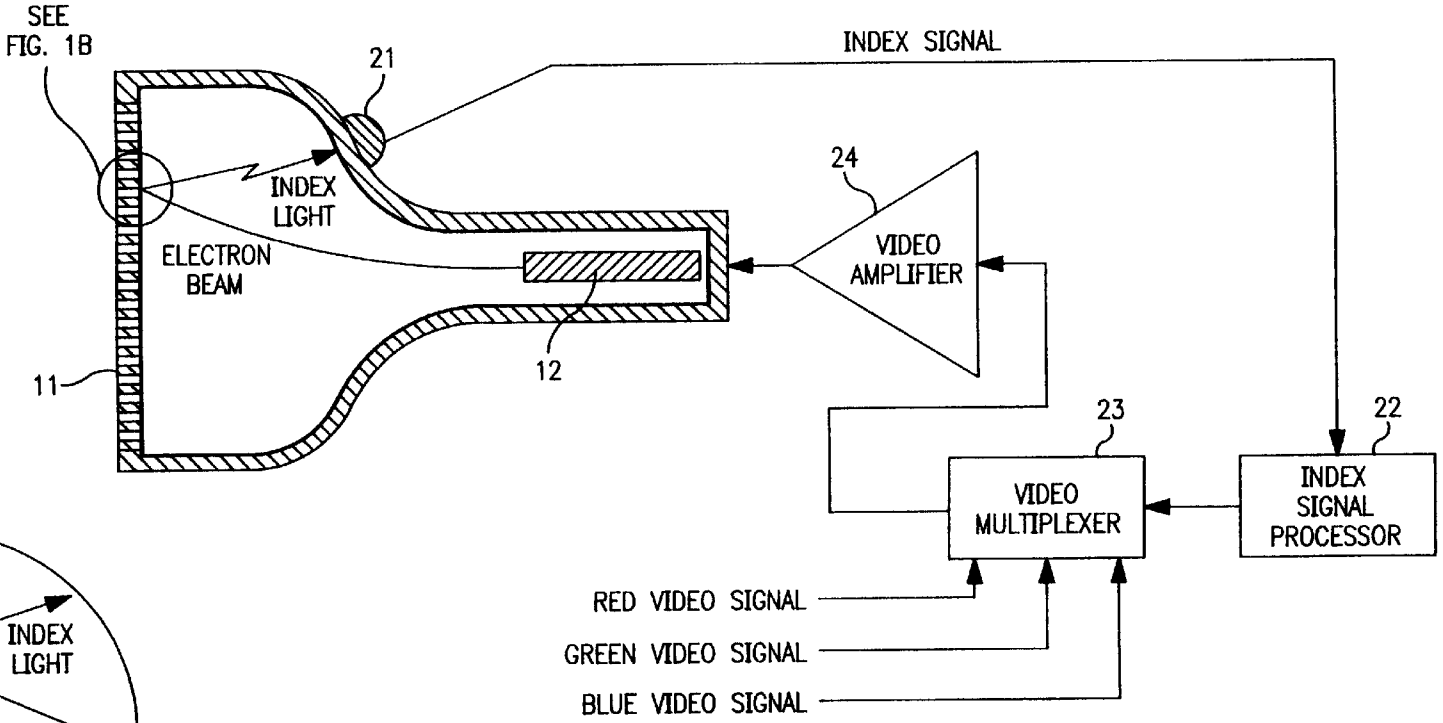
FIG. 1A is a conventional beam index tube.
Figure 1B:
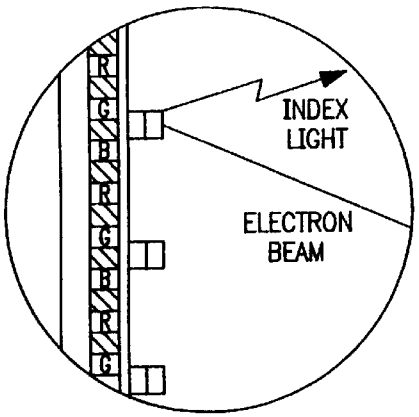
FIG. 1B is an exploded view of the screen pattern of FIG. 1A.
Figure 2:
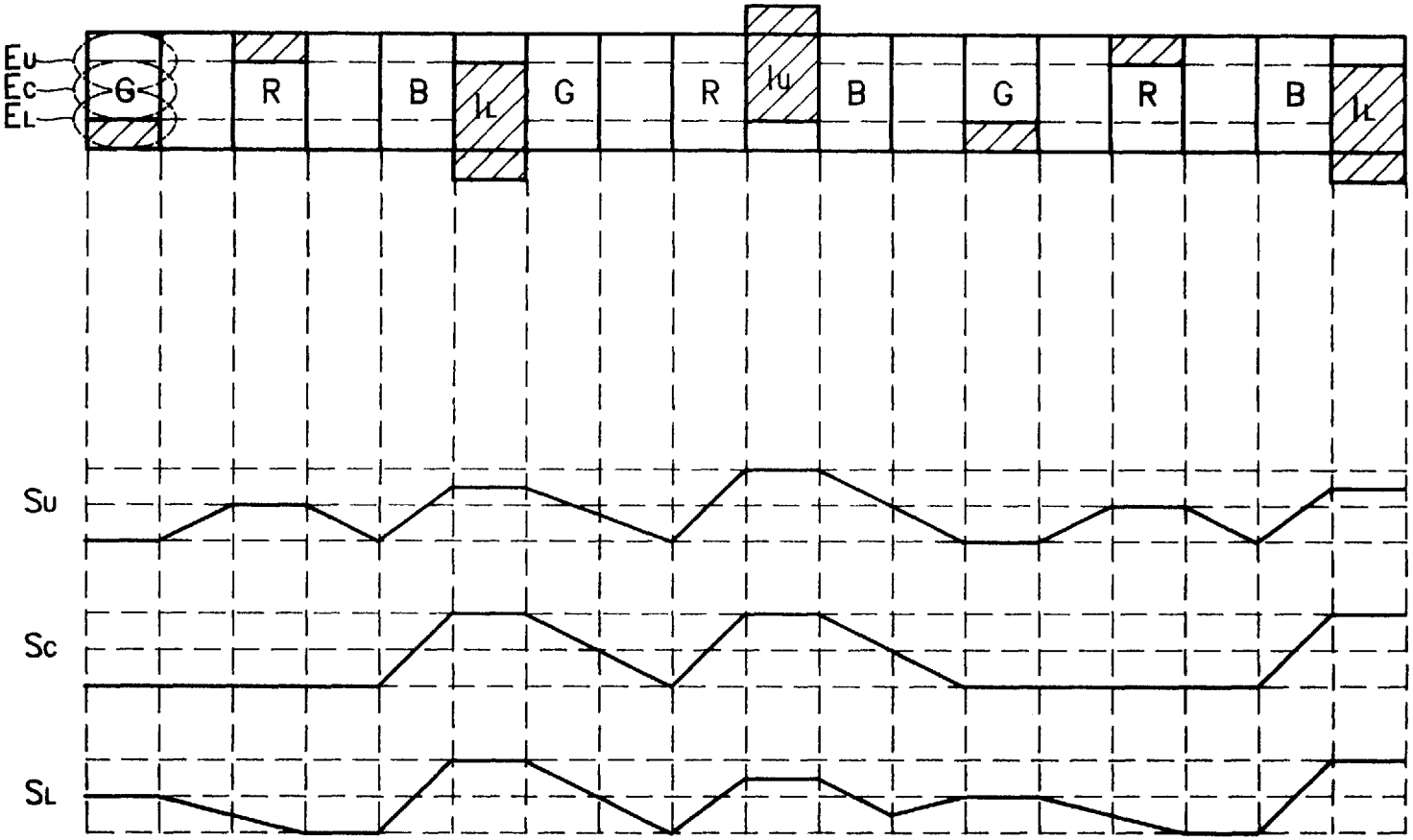
FIG. 2 (PRIOR ART)
FIG. 2 is a diagram illustrating an index signal with respect to a horizontal pattern shown in FIG. 1.
Figure 3:
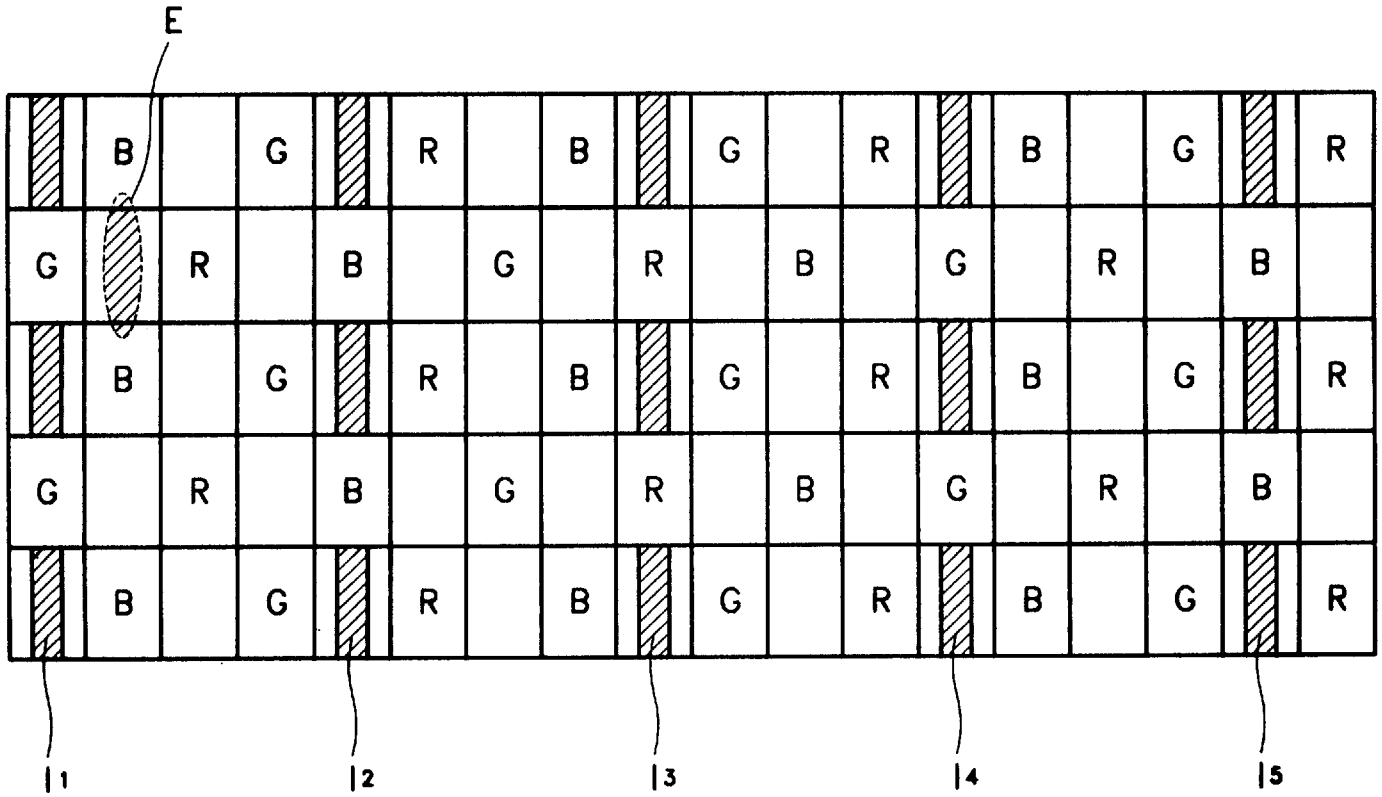
FIG. 3 is a diagram illustrating a screen pattern of a beam index tube according to the present invention.

In FIG. 3, $I_1$, $I_2$, $I_3$, $I_4$, and $I_5$ denote index stripes which traverse a fluorescent surface with a predetermined interval, and E represents an electron beam spot having a vertically elliptical shape. As shown in FIG. 3, each stripe area is partitioned in a mesh, and red R, green G, and blue B stripes, each of which occupies the same area, are regularly arranged. Here, red R, green G and blue B stripes are arranged in the horizontal and vertical directions by skipping one mesh in each direction. Thus, the allowable size of the horizontal and vertical spot sizes of the scanning electron beam can be increased. Also, according to the beam index tube of the present invention, the index stripes, $I_1$, $I_2$, $I_3$, $I_4$, and $I_5$ are arranged with each predetermined interval in the horizontal and vertical directions, located in the fluorescent surface without being spaced from the red R, green G, and blue B stripes. In addition, the index stripes $I_1$, $I_2$, $I_3$, $I_4$, and $I_5$ are arranged among the red R, green G, and blue B color stripes so as to be spaced from at least one of the color stripes by an interval of three meshes in the horizontal direction and one mesh in the vertical direction. Also, the electron beam spot E having a vertically elliptical shape can be used, so that the vertical deflection correction for the electron beam can be omitted.

Figure 4:
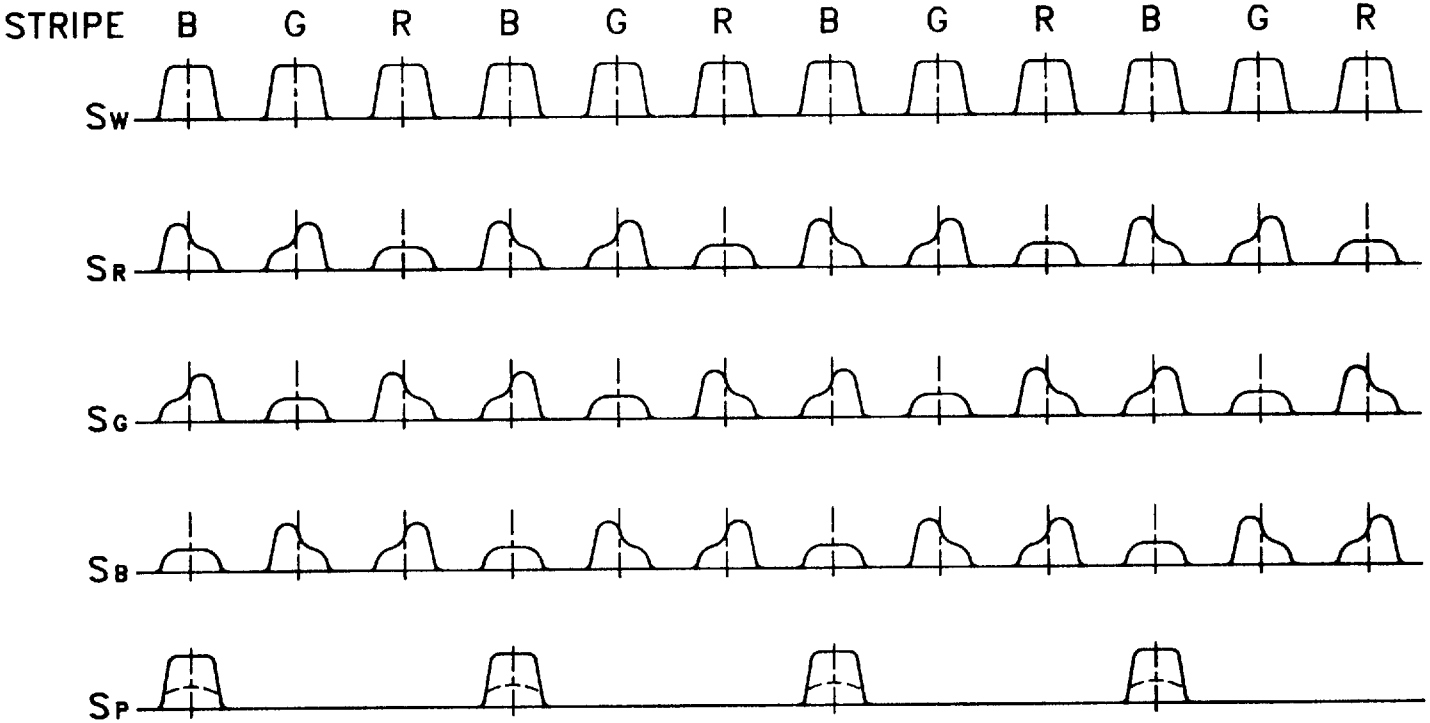
FIG. 4 is a diagram illustrating an index signal with respect to a horizontal pattern shown in FIG. 3.

FIG. 4 is a diagram illustrating an index signal with respect to a horizontal pattern shown in FIG. 3.

In FIG. 4, $S_W$ is an index signal for the electron beam of a white field, $S_R$ is an index signal for the electron beam of a red field, $S_G$ is an index signal for the electron beam of a green field, $S_B$ is an index signal for the electron beam of a blue field, and $S_P$ is an index signal detecting predetermined phase information. As shown in FIG. 4, the index signal $S_W$ has the same waveform with respect to each stripe. Also, the index signals $S_R$, $S_G$, and $S_B$ represent relatively different waveforms according to the color of the fluorescent stripes. In addition, the index signal $S_P$ generates a pulse every time the electron beam reaches an index stripe. The position of the electron beam is controlled in accordance with the index pulses, thereby displaying a highly accurate color image.

As described above, according to the beam index tube of the present invention, the index stripes $I_1$, $I_2$, $I_3$, $I_4$, and $I_5$ are arranged with a predetermined interval in each of the horizontal and vertical directions, located in the fluorescent surface without being spaced. Also, the electron beam spot E having a vertically elliptical shape can be used, so that the vertical deflection correction of the electron beam is not required.

In addition, according to the beam index tube of the present invention, the vertical deflection correction means for the electron beam is unnecessary, thereby preventing the deterioration of the picture quality due to the earth's magnetic field and reducing manufacturing costs accordingly.

The present invention is not limited to the particular forms illustrated and further modifications and improvements will occur to those skilled in the art.

What is claimed is:

1. A screen for a beam index tube comprising a fluorescent surface having a pattern of color stripes, respectively producing red, green, and blue light in a plurality of color unit areas within each of the respective stripes in response to an incident electron beam, and index unit areas regularly arranged in the pattern, the color stripes being arranged side-by-side and along a vertical direction with color unit areas of vertical stripes being in registration along a horizontal direction, each color unit area being spaced in the horizontal and vertical directions from nearest color unit areas by one unit area, and the index unit areas being disposed among the color unit areas and spaced from nearest index unit areas by three unit areas in the horizontal direction and one unit area in the vertical direction.

2. A beam index tube comprising:

a tube assembly;

an electron gun for generating an electron beam; and a screen assembly including a fluorescent surface having a pattern of color stripes, respectively producing red, blue, and green light in a plurality of color unit areas within each of the respective stripes in response to an incident electron beam, and index unit areas regularly arranged in the pattern, the color stripes being arranged side-by-side and along a vertical direction with color unit areas of vertical stripes being in registration along a horizontal direction, each color unit area being spaced in the horizontal and vertical directions from nearest color unit areas by one unit area, and the index unit areas being disposed among the color unit areas and spaced from nearest index unit areas by three unit areas in the horizontal direction and one unit area in the vertical direction.

3. The beam index tube of claim 2 wherein the electron beam produces a beam spot on the fluorescent surface having a vertically elliptical shape.

4. The screen assembly of claim 1 wherein each index unit area is contiguous to three color unit areas respectively producing red, green, and blue light in response to an incident electron beam.

5. The screen assembly of claim 1 wherein each index unit area includes an index stripe smaller than the index unit area.

6. The beam index tube according to claim 2 wherein, in the screen assembly, each index unit area is contiguous to three color unit areas respectively producing red, green, and blue light in response to an incident electron beam.

7. The beam index tube according to claim 2 wherein, each index unit area includes an index stripe smaller than the index unit area.

* * * * *